US005765870A

United States Patent [19]

Riley

[11] Patent Number: 5,765,870

[45] Date of Patent: Jun. 16, 1998

[54] ADJUSTABLE INLINE SKATE STORAGE AND WALKING SHOE

[76] Inventor: Richard Riley, 67420 Central Ave., Bridgeport, Ohio 43912

[21] Appl. No.: 465,864

[22] Filed: Jun. 6, 1995

[51] Int. Cl.[6] ..... A63C 3/12

[52] U.S. Cl. ..... 280/825

[58] Field of Search ..... 280/825, 7.13, 280/11.22, 11.12; 36/122

[56] References Cited

U.S. PATENT DOCUMENTS

| | | | |
|---|---|---|---|
| D. 287,548 | 1/1987 | Kraynack-Simon | D3/36 |
| 2,187,687 | 2/1940 | English | 280/7.13 |
| 2,209,116 | 7/1940 | Friedmann | 280/11.1 |
| 3,884,485 | 5/1975 | Walle | 280/11.1 R |
| 3,983,643 | 10/1976 | Schreyer et al. | 36/115 |
| 4,333,249 | 6/1982 | Schaefer | 36/115 |
| 4,382,615 | 5/1983 | Gronborg et al. | 280/825 |
| 5,303,955 | 4/1994 | Zurnamer | 280/825 |
| 5,398,970 | 3/1995 | Tucky | 280/841 |
| 5,445,415 | 8/1995 | Campbell | 280/825 |
| 5,513,881 | 5/1996 | DiMeglio et al. | 280/825 |
| 5,522,621 | 6/1996 | Schneider | 280/825 |
| 5,580,094 | 12/1996 | Ruehlman et al. | 280/825 |

FOREIGN PATENT DOCUMENTS

| | | | |
|---|---|---|---|
| 1062301 | 9/1979 | Canada | 280/825 |
| 400873 | 4/1963 | Switzerland | 280/825 |

*Primary Examiner*—Richard M. Camby
*Attorney, Agent, or Firm*—Buchanan Ingersoll, P.C.

[57] ABSTRACT

An adjustable shoe for inline skates has a front shoe portion and a rear shoe portion which are connected by a track that permits the front and rear portions to be moved relative to one another. A cavity in the front and rear shoe portions is sized and shaped to receive the chassis and wheels of an inline skate. Adjustable side plates and straps are provided to secure the shoe to an inline skate.

22 Claims, 3 Drawing Sheets

ADJUSTABLE INLINE SKATE STORAGE AND WALKING SHOE

FIELD OF INVENTION

The invention relates to inline skates sometimes referred to as roller blades, and is a shoe that can be used to store your inline skates in an upright position for convenient storage.

BACKGROUND OF THE INVENTION

Inline skates also known as roller blade skate are well known. The old fashion roller skate consisted of a boot or shoe with four wheels attached on each of four corners. The inline skate also consists of four wheels; however, the wheels are in a straight line, one behind the other, with an attached rubber brake block behind the rear wheel. One problem that exists with the inline skate is that it won't stand in an upright position, making it a nuisance item. It is also a fact that you cannot wear these skates into stores or restaurants, because of damage caused to the floor surfaces by the wheels and rubber brake pads, which causes an inconvenience. For ice skates it is known to use a rubber cover over the blade. Because inline skates have several wheels this cover is not suitable. Additionally, the ice skate cover does not permit the skate to stand up. There is no technology at the present time to solve these particular problems with the inline skates.

The art has developed several convertible skates. U.S. Pat. No. 2,148,687 discloses an improvement that allows the user to convert a roller skate to an ice skate as desired. U.S. Pat. No. 2,209,116 discloses a skate that can be adapted as a roller skate or an ice skate. A collapsible roller skate consisting of two wheels in the front and one in the rear is disclosed in U.S. Pat. No. 3,884,485. The wheels are retractable into a platform type shoe, or locked in the down position for roller skating. Another shoe usable for walking and roller-skating is described in U.S. Pat. No. 3,983,643. A deep platform shoe has four retractable wheels, two in the front and two in the rear, like the old fashion skate. In U.S. Pat. No. 4,333,249, there is a similar convertible sport device. This device consists of a deep housing attachable to a shoe with four wheels, two in the front and two in the rear, side by side, which wheels are retractable when not skating. Another shoe for walking and roller skating is the subject of U.S. Pat. No. 5,398,970. This shoe has four wheels one on each corner, the wheels are on the outside of the shoe and can be raised or lowered for either walking or skating. None of the skates in these prior art patents are inline skates. Furthermore, all of these skate and shoe products are relatively complex and expensive. None of the convertible systems can be used on currently available inline skates without substantially modifying those skates.

There is a need for an inexpensive, easy to use device that converts commercially available inline skates into walking shoes. That device should be adjustable to fit all skate sizes.

OBJECTS AND SUMMARY OF THE INVENTION

The objective of the present invention is to provide a storage and walking shoe to accommodate inline skates of different sizes. The device is structured so that it is adjustable to fit any size inline skate. The shoe consists of a front and a rear section that are similar in size and shape. They are joined together with an adjustable track, which allows the two halves to become one, when one part of the track is inserted into the other. This allows the shoe to be adjusted to various sizes. The front section is placed up and around the front wheel. The rear section is then shoved forward or pulled out to the proper length to the point where it cradles the rear wheel. When so positioned, the skates will sit comfortably in the shoe and be unable to roll out of position. In order to assure stability and a snug fit, there is a cavity in the bottom of the shoe into which the wheels fit, restricting side movement when the skates are dropped into place.

The side walls of the skate shoe preferably are sized to extend all the way up to the base of the inline skate boot. Alternatively, adjustable support plates can be provided. The object of the adjustable support plates is to assure that the shoe will fit any and all makes and models of skates, regardless of configuration. The plates are placed against the side of the shoe, and are slotted. A nut is properly placed in the side of the shoe to accept locking screws, which lock the plate after the plate has been placed in the proper position. After the inline skate is properly cradled in place, the adjustable plates can be set tight against the base of the inline skate boot and chassis and locked into place by tightening the locking screws. Support plates when used, can be locked into place. This procedure would be completed immediately after purchase.

It is also the object of the invention to tightly secure the shoe to the skate. This is done by the use of two straps, one strap comes from the shoe, about 2" from the toe of the body and up around the front portion of the skate boot, about where the laces begin, and is secured tightly. Velcro fasteners, a buckle attachment or any method that will secure the shoe to the inline skate can be used. The rear strap comes from the rear of the shoe, up and around the ankle portion of the skate and secured in the same fashion.

The inline skate shoe can quickly be slipped over the rollers, strapped into place and used for walking or storing the inline skate. For comfort, a soft sole and heal could be added to the bottom of the shoe.

Other objects and advantages will become apparent from a description of certain present preferred embodiments thereof which are shown in the drawings.

DETAILED DESCRIPTION OF THE PREFERRED EMBODIMENTS

Figure 1:
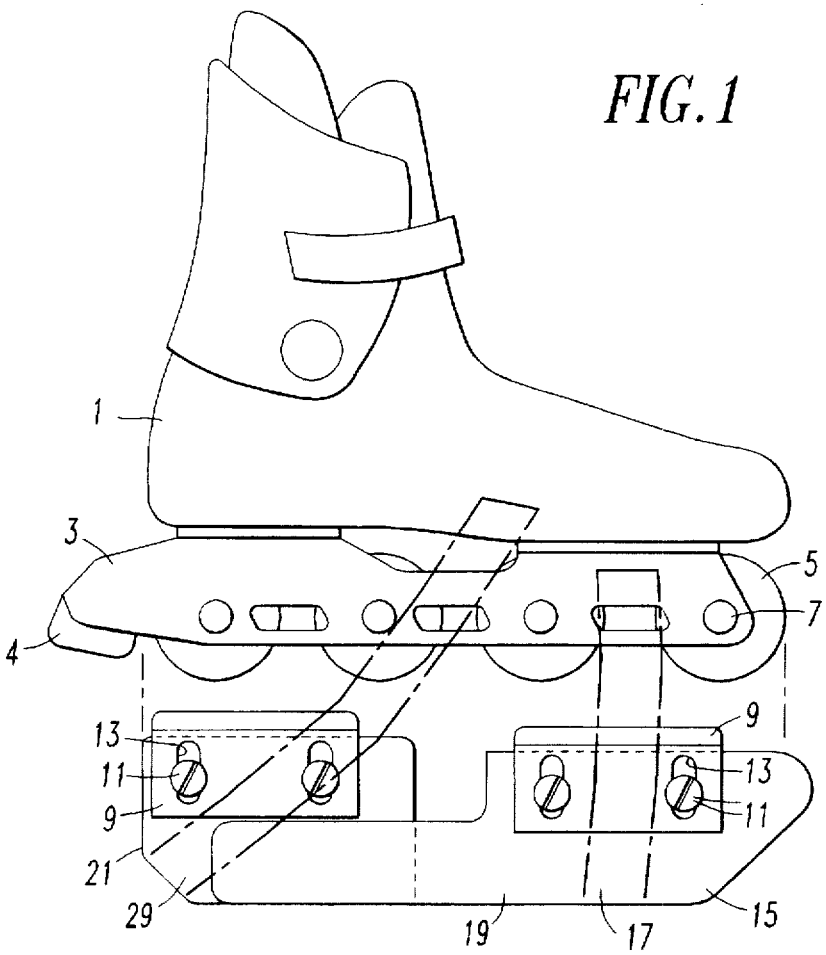
FIG. 1 is a side view of the inline skate positioned above a present preferred embodiment of my adjustable inline skate walking and, or, storage shoe in a mounting position, ready to be strapped to the inline skate.
Figure 2:
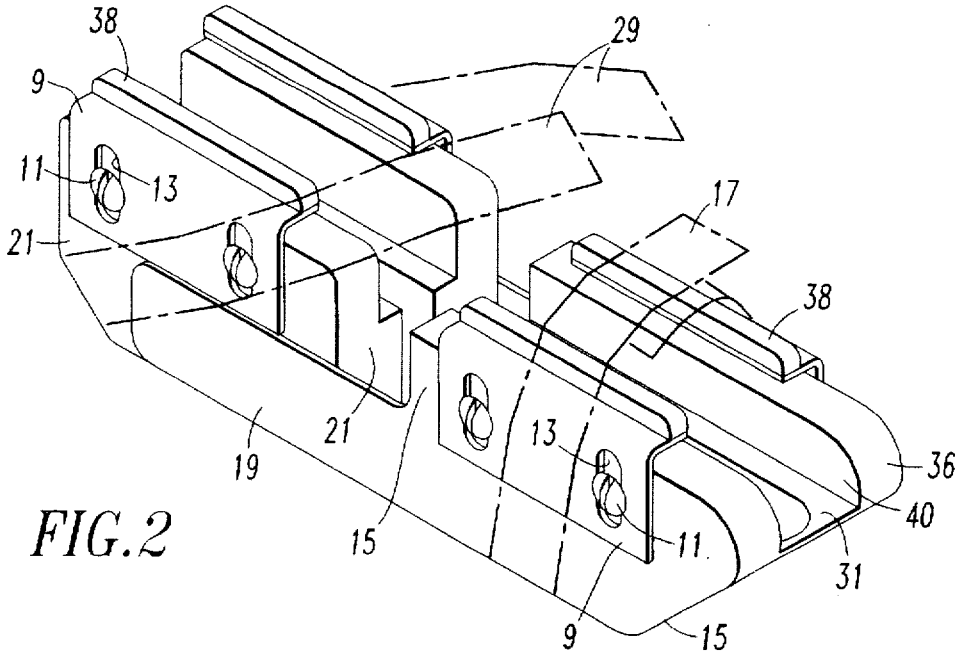
FIG. 2 is a perspective view of the adjustable inline skate walking shoe of FIG. 1.
Figure 3:
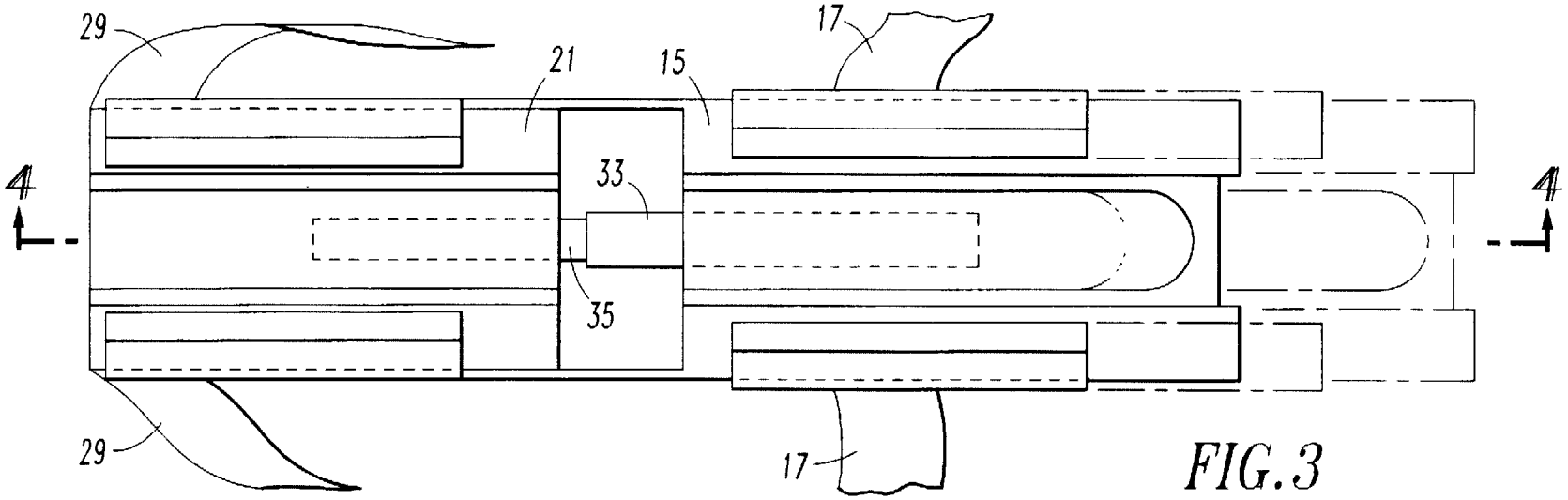
FIG. 3 is a top view of the shoe of FIG. 1 showing the adjustment capabilities, and the track used to extend the shoe for larger size skates
Figure 4:
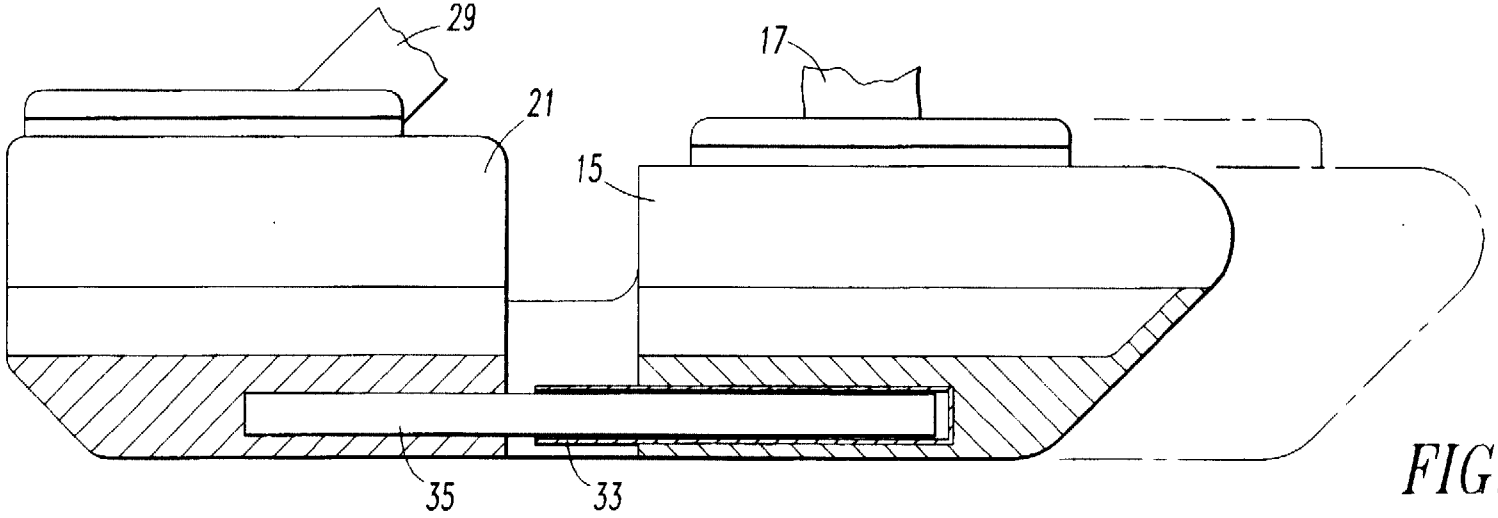
FIG. 4 is a sectional view taken along the line IV-IV of FIG. 3.
Figure 5:
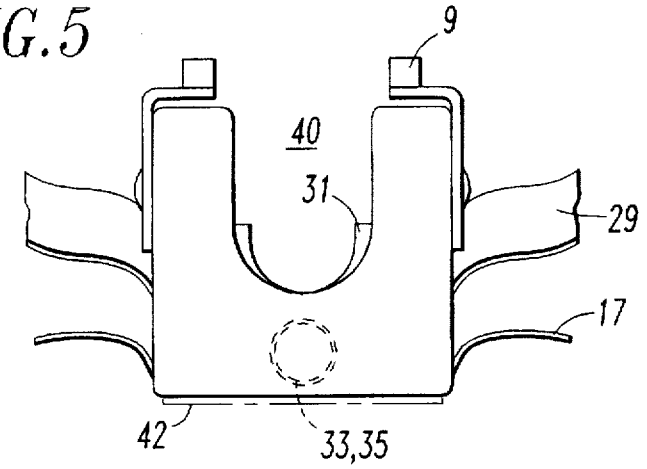
FIG. 5 is a rear view of the shoe of FIGS. 1 thru 4.

A conventional inline skate as shown in FIG. 1 has a boot attached to a chassis 3, having a brake 4. A plurality of wheels 5 are mounted on the chassis. Each wheel 5 is held in place by an axle 7 which extends outward from both sides of the chassis. The first preferred embodiment of my skate shoe shown in FIGS. 1 thru 5 has front and rear sections 15 and 21. These sections are joined together by inserting the rear track 35 into the front track 33. The tracks allow the shoe to elongate and retract for different skates. A side extension 19 is attached to either side of the front section 15 of the body and covers the track and the opening between sections 15 and 21 as the shoe is adjusted. The chassis 3 of the inline skate is placed in the cavity 40 of the shoe with the front wheel 5 resting as far forward as possible. Then, the track is slid together until the back of the rear section 21 is snug against the rear wheel and the inline skate is snugly cradled in the shoe. As shown in FIGS. 2 and 5, the cavity 40 preferably has a lower portion 31 into which the wheels drop. This cavity cradles snugly against the sides of the lower portion of the wheels for stability. Upper portion of cavity 40 is sized to receive the chassis 3 of the inline skate. I prefer to make the front and rear sections 15 and 21 of a shoe for adult skates 5 inches in length. The outer ends of both halves 15 and 21 can be curved to form, and wrap around a portion of the wheel. The front could be 2 ¾" in height and the rear 3 ¾" in height in order to fit snugly up against the inline skate boot and chassis or they can both be the same size for ease of manufacturing. Adjustable support plates 9 can be used to secure the shoe tightly against the chassis of the skate.

The optional adjustable support plates 9 with the adjustment slots 13 which are ¾" long and are used when snugging the plates up against the boot. Screws 11 are used to lock each plate in place. The nuts that receive screws 11 are preferably properly placed and anchored in the shoe body when it is manufactured. The top 38 of each plate is contoured to fit over the front and rear sections 15 and 21. The width between the top 38 of the adjustable support plates 9 is adjustable. These plates can be made of metal, aluminum, plastic, or any type of material that will support the weight of a weighted skate, covering enough area so it will not cut into the base of the inline skate. The adjustable support plates 9 on the embodiment of FIGS. 1 and 2 are preferably 2" in height and 3" long. These plates could be as small as 1" in length. Indeed, any length which supports the necessary weight can be used. The width of the side wall 36 of the embodiment of FIGS. 1 thru 5 may be as thin as 1/16" as long as the shoe is structurally safe. The front and rear sections 15 and 21 can be constructed of wood, aluminum, metal alloys, plastic, fiberglass, nylon or any type of material that would support the person wearing the inline skate. Any type of soft or cushioned sole and heel material 42 may be added to the bottom of the shoe for walking comfort as indicated by chainline in FIG. 5. Straps 17 and 19 are provided to hold the shoe in place. These straps can be made of Velcro fasteners, elastic, or any type of material or latching device that will secure the shoe to the inline skate. Also, the straps of the light weight device can be used to hang the shoes on the wearer's belt while skating. The shoes can quickly be removed from the belt, slipped over the roller blades and strapped to the skate boot for walking, allowing a person to enter stores and restaurants without removing the skates.

For storage purposes this invention includes the possible design of a smaller embodiment that would consist of the adjustable track with a cavity into which the skate is placed and front and rear sections just wide enough to assure that the skate would be kept in an upright position. The track can be constructed of square tubing, round pipe, a horse-shoe shape, flat track, drawer sliding track or any other suitable configuration. The track can be made of metal, aluminum or any other material that will withstand the weight of a large person wearing the inline skate shoe.

Figure 6:
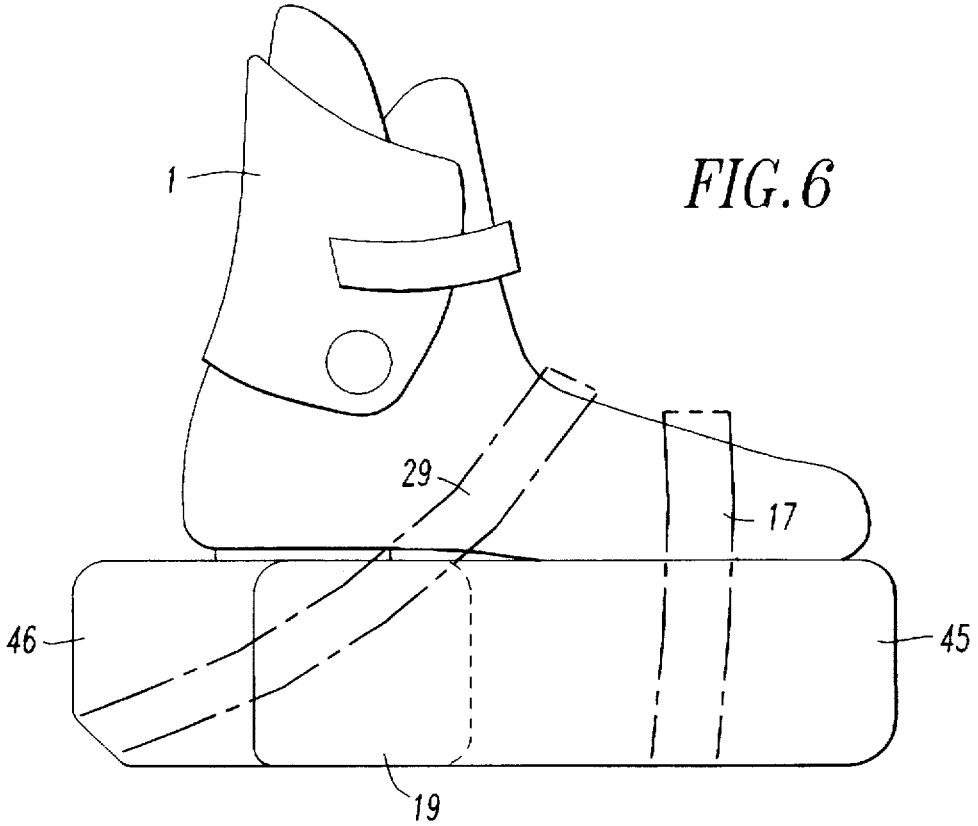
FIG. 6 is a side view of an inline skate and a second preferred embodiment of my skate shoe which covers the rear brake pad of the inline skate.

FIG. 6 shows a second embodiment which does not use the adjustable support plates. The front and rear sections 45 and 46 both extend up tight against the skate boot. The front and rear sections 45 and 46 are preferably joined together by inserting the rear track into the front track in the same manner as the first embodiment. Like the first embodiment a cover 19 extends from the front section 45. This embodiment is practical when manufacturing the shoe for a particular brand or brands of skates but may not fit all applications. The shoe shown in FIG. 6 is sized so that the rear portion 6 fits over the brake of the skate. Straps 17 and 29 are provided to secure the shoe to the skate.

The present preferred embodiments are a two piece shoe connected by a track to permit size adjustments. It is also possible to form the two sections as a single piece without the track. This one piece shoe would properly fit only the size of inline skate whose chassis and wheels fit securely in the cavity. Additionally, the one piece shoe could be used as a stand for storing other sizes of inline skates.

While the invention has been described in connection with certain present preferred embodiments thereof, it is evident that many alternatives, modifications, and variations will be apparent to those skilled in the art in light of the foregoing teachings. Accordingly the invention is intended to embrace all such alternatives, modifications, and variations as fall within the spirit and scope of the appended claims.

I claim:

1. An adjustable shoe that can be used for storing an inline skate a generally upright position comprising:

a) a front shoe portion having a front cavity sized and shaped to receive a front portion of an inline skate wheels, the cavity having a width and the front shoe portion having a bottom at least 2.5 times as wide as the cavity for the wheels;

b) a rear shoe portion having a rear cavity sized and shaped to receive a rear portion of an inline skate wheels, the cavity having a width and the front shoe portion having a bottom at least 2.5 times as wide as the cavity for the wheels;

c) a track extending between the front shoe portion and the rear shoe portion which maintains the front cavity in alignment with the rear cavity and permits the front shoe portion and rear shoe portion to be moved relative to one another; and d) securing means for securing the front shoe portion and rear shoe portion to the inline skate;

so that when an inline skate is placed in the adjustable shoe, the inline skate will be held in a generally upright position when the adjustable shoe is placed on a flat surface.

2. The adjustable shoe of claim 1 wherein the securing means is at least one strap attached to one of the front shoe portion and the rear shoe portion.

3. An adjustable shoe that can be used for storing an inline skate in a generally upright position comprising:

a) a front shoe portion having a front cavity sized and shaped to receive a front portion of an inline skate chassis and attached wheels and having a bottom;

b) a rear shoe portion having a rear cavity sized and shaped to receive a rear portion of an inline skate chassis and attached wheels and having a bottom;

c) a track extending between the front shoe portion and the rear shoe portion which maintains the front cavity in alignment with the rear cavity and permits the front shoe portion and rear shoe portion to be moved relative to one another; and d) at least one pair of securing plates attached to opposite sides of one of the front shoe portion and the rear shoe portion for securing the front shoe portion and rear shoe portion to the inline skate.

4. The adjustable shoe of claim 3 wherein the at least one pair of securing plates is adjustably attached to permit each securing plate to be moved toward and away from a boot of an inline skate placed in the adjustable shoe.

5. The adjustable shoe of claim 1 wherein the rear cavity is sized and shaped to also receive a brake of the inline skate.

6. The adjustable shoe of claim 1 wherein the rear shoe portion is sized and shaped so that a brake of an inline skate placed in the adjustable shoe will not be within the rear cavity.

7. An adjustable shoe that can be used for storing an inline skate in a generally upright position comprising:

a) a front shoe portion having a front cavity sized and shaped to receive a front portion of an inline skate chassis and attached wheels and having a bottom;

b) a rear shoe portion having a rear cavity sized and shaped to receive a rear portion of an inline skate chassis and attached wheels and having a bottom;

c) a track extending between the front shoe portion and the rear shoe portion which maintains the front cavity in alignment with the rear cavity and permits the front shoe portion and rear shoe portion to be moved relative to one another;

d) securing means for securing the front shoe portion and rear shoe portion to the inline skate; and e. a pair of covers attached to opposite sides of the front shoe portion and each cover extending to overlap a portion of the rear shoe portion.

8. The adjustable shoe of claim 1 wherein the front shoe portion and the rear shoe portion are of a size, shape and weight to permit a wearer of a pair of inline skates to each of which inline skates the adjustable shoe has been attached to walk comfortably.

9. The adjustable shoe of claim 1 also comprising a soft sole attached to the front shoe portion and a soft heel attached to the rear portion.

10. The adjustable shoe of claim 1 wherein the front cavity and rear cavity have an upper portion sized to receive the chassis of an inline skate and a lower portion sized and shaped to receive a portion of the wheels attached to the chassis.

11. An adjustable shoe that can be used for storing an inline skate in a generally upright position comprising:

a) a shoe body having a flat bottom and a cavity open at a top of the shoe body which cavity is sized and shaped to receive an inline skate wheels, the wheels having a width and the shoe body haven a width at least 2.5 times as wide as the cavity for the wheels so that when an inline skate is placed in the adjustable shoe, the inline skate will be held in a generally upright position when the adjustable shoe is placed on a flat surface; and b) securing means for securing the shoe body to the inline skate.

12. The adjustable shoe of claim 11 wherein the securing means is at least one strap attached to the shoe body.

13. An adjustable shoe that can be used for storing an inline skate in a generally upright position comprising:

a) a front shoe portion having a front cavity sized and shaped to receive a front portion of an inline skate chassis and attached wheels;

b) a rear shoe portion having a rear cavity sized and shaped to receive a rear portion of an inline skate chassis and attached wheels;

c) a track extending between the front shoe portion and the rear shoe portion which maintains the front cavity in alignment with the rear cavity and permits the front shoe portion and rear shoe portion to be moved relative to one another; and d) at least one pair of securing plates attached to the shoe body for securing the front shoe portion and rear shoe portion to the inline skate.

14. The adjustable shoe of claim 13 wherein the at least one pair of securing plates is adjustably attached to permit each securing plate to be moved toward and away from a boot of an inline skate placed in the adjustable shoe.

15. The adjustable shoe of claim 11 wherein the cavity is sized and shaped to also receive a brake of the inline skate.

16. The adjustable shoe of claim 1 wherein the shoe body is sized and shaped so that a brake of an inline skate placed in the adjustable shoe will not be within the cavity.

17. The adjustable shoe of claim 11 wherein the shoe body is of a size, shape and weight to permit a wearer of a pair of inline skates to each of which inline skates the adjustable shoe has been attached to walk comfortably.

18. The adjustable shoe of claim 11 also comprising a soft sole attached to the shoe body.

19. The adjustable shoe of claim 11 wherein the cavity has an upper portion sized to receive the chassis of an inline skate and a lower portion sized and shaped to receive a portion of the wheels attached to the chassis.

20. An adjustable shoe that can be used for storing a skate in a generally upright position comprising:

a) a front shoe portion having a front cavity sized and shaped to receive a front portion of a skate blade and having a bottom at least 2.5 times as wide as the cavity for the skate blade;

b) a rear shoe portion having a rear cavity sized and shaped to receive a rear portion of a skate blade and having a bottom at least 2.5 times as wide as the cavity for the skate blade;

c) a track extending between the front shoe portion and the rear shoe portion which maintains the front cavity in alignment with the rear cavity and permits the front shoe portion and rear shoe portion to be moved relative to one another; and d) securing means for securing the front shoe portion and rear shoe portion to the skate so that when a skate is placed in the adjustable shoe, the skate will be held in a generally upright position when the adjustable shoe is placed on a flat surface.

21. The adjustable shoe of claim 20 wherein the securing means is at least one strap attached to one of the front shoe portion and the rear shoe portion.

22. The adjustable shoe of claim 1 wherein the front shoe portion and the rear shoe portion are of a size, shape and weight to permit a wearer of a pair of skates to each of which skates the adjustable shoe has been attached to walk comfortably.

* * * * *